US007756428B2

(12) United States Patent
Anderson et al.

(10) Patent No.: US 7,756,428 B2
(45) Date of Patent: Jul. 13, 2010

(54) MEDIA PATH DIAGNOSTICS WITH HYPER MODULE ELEMENTS

(75) Inventors: David G. Anderson, Ontario, NY (US); Gregory Kott, Fairport, NY (US)

(73) Assignee: Xerox Corp., Norwalk, CT (US)

( * ) Notice: Subject to any disclaimer, the term of this patent is extended or adjusted under 35 U.S.C. 154(b) by 629 days.

(21) Appl. No.: 11/314,828

(22) Filed: Dec. 21, 2005

(65) Prior Publication Data

US 2007/0140711 A1 Jun. 21, 2007

(51) Int. Cl.
*G03G 15/00* (2006.01)

(52) U.S. Cl. ..... 399/16; 399/18; 347/116; 271/184

(58) Field of Classification Search ..... 399/16, 399/18; 347/116; 271/184
See application file for complete search history.

(56) References Cited

U.S. PATENT DOCUMENTS

| | | | |
|---|---|---|---|
| 4,579,446 | A | 4/1986 | Fujino et al. |
| 4,587,532 | A | 5/1986 | Asano |
| 4,836,119 | A | 6/1989 | Siraco et al. |
| 5,004,222 | A | 4/1991 | Dobashi |
| 5,080,340 | A | 1/1992 | Hacknauer et al. |
| 5,095,342 | A | 3/1992 | Farrell et al. |
| 5,159,395 | A | 10/1992 | Farrell et al. |
| 5,208,640 | A | 5/1993 | Horie et al. |
| 5,272,511 | A | 12/1993 | Conrad et al. |
| 5,326,093 | A | 7/1994 | Sollitt |
| 5,435,544 | A | 7/1995 | Mandel |
| 5,473,419 | A | 12/1995 | Russel et al. |
| 5,489,969 | A | 2/1996 | Soler et al. |
| 5,504,568 | A | 4/1996 | Saraswat et al. |
| 5,525,031 | A | 6/1996 | Fox |
| 5,557,367 | A | 9/1996 | Yang et al. |
| 5,568,246 | A | 10/1996 | Keller et al. |
| 5,570,172 | A | 10/1996 | Acquaviva |
| 5,596,416 | A | 1/1997 | Barry et al. |

(Continued)

OTHER PUBLICATIONS

Morgan, P.F., "Integration of Black Only and Color Printers", Xerox Disclosure Journal, vol. 16, No. 6, N 1991, pp. 381-383.

(Continued)

*Primary Examiner*—Judy Nguyen
*Assistant Examiner*—Andy L Pham
(74) *Attorney, Agent, or Firm*—Fay Sharpe LLP

(57) ABSTRACT

A system for handling media sheets is provided which comprises a plurality of hardware components including a first image marking engine operative to mark media sheets, and a second image marking engine operative to mark media sheets. In addition, the plurality of hardware components can include a first object delivery path operative to transport media sheets presented by the first image marking engine to a first destination, and a second object delivery path operative to transport media sheets presented by the second image marking engine to a second destination. The first and second destinations may be a single destination, separate destinations, or interchangeable destinations. One of the first and second delivery paths can be redundant. At least one of the first and second delivery paths includes a hyper module for transporting a series of diagnostic media sheets in both forward and reverse directions through a first recursive loop through the plurality of hardware components within the system during a diagnostic sequence whereby a fault is detected.

6 Claims, 4 Drawing Sheets

U.S. PATENT DOCUMENTS

| | | | | |
|---|---|---|---|---|
| 5,629,762 | A | 5/1997 | Mahoney et al. | |
| 5,710,968 | A | 1/1998 | Clark et al. | |
| 5,778,377 | A | 7/1998 | Marlin et al. | |
| 5,884,910 | A | 3/1999 | Mandel | |
| 5,995,721 | A | 11/1999 | Rourke et al. | |
| 6,059,284 | A | 5/2000 | Wolf et al. | |
| 6,091,929 | A | 7/2000 | Yamazaki | |
| 6,115,510 | A | 9/2000 | Koga | |
| 6,125,248 | A | 9/2000 | Moser | |
| 6,134,019 | A | 10/2000 | Wantuck | |
| 6,241,242 | B1 | 6/2001 | Munro | |
| 6,269,237 | B1 * | 7/2001 | Olbrich et al. | 399/401 |
| 6,297,886 | B1 | 10/2001 | Cornell | |
| 6,341,773 | B1 | 1/2002 | Aprato et al. | |
| 6,384,918 | B1 | 5/2002 | Hubble, III et al. | |
| 6,450,711 | B1 | 9/2002 | Conrow | |
| 6,453,132 | B2 | 9/2002 | Ishikura | |
| 6,473,539 | B1 | 10/2002 | Koga | |
| 6,476,376 | B1 | 11/2002 | Biegelsen et al. | |
| 6,476,923 | B1 | 11/2002 | Cornell | |
| 6,493,098 | B1 | 12/2002 | Cornell | |
| 6,537,910 | B1 | 3/2003 | Burke et al. | |
| 6,550,762 | B2 | 4/2003 | Stoll | |
| 6,554,276 | B2 | 4/2003 | Jackson et al. | |
| 6,577,925 | B1 | 6/2003 | Fromherz | |
| 6,607,320 | B2 | 8/2003 | Bobrow et al. | |
| 6,608,988 | B2 | 8/2003 | Conrow | |
| 6,612,566 | B2 | 9/2003 | Stoll | |
| 6,612,571 | B2 | 9/2003 | Rider | |
| 6,621,576 | B2 | 9/2003 | Tandon et al. | |
| 6,633,382 | B2 | 10/2003 | Hubble, III et al. | |
| 6,639,669 | B2 | 10/2003 | Hubble, III et al. | |
| 6,819,906 | B1 | 11/2004 | Herrmann et al. | |
| 6,925,283 | B1 | 8/2005 | Mandel et al. | |
| 6,959,165 | B2 | 10/2005 | Mandel et al. | |
| 2002/0078012 | A1 | 6/2002 | Ryan et al. | |
| 2002/0103559 | A1 | 8/2002 | Gartstein | |
| 2003/0077095 | A1 | 4/2003 | Conrow | |
| 2004/0085561 | A1 | 5/2004 | Fromherz | |
| 2004/0085562 | A1 | 5/2004 | Fromherz | |
| 2004/0088207 | A1 | 5/2004 | Fromherz | |
| 2004/0150156 | A1 | 8/2004 | Fromherz et al. | |
| 2004/0150158 | A1 | 8/2004 | Biegelsen et al. | |
| 2004/0153983 | A1 | 8/2004 | McMillan | |
| 2004/0216002 | A1 | 10/2004 | Fromherz et al. | |
| 2004/0225391 | A1 | 11/2004 | Fromherz et al. | |
| 2004/0225394 | A1 | 11/2004 | Fromherz et al. | |
| 2004/0247365 | A1 | 12/2004 | Lofthus et al. | |

OTHER PUBLICATIONS

Desmond Fretz, "Cluster Printing Solution Announced", Today at Xerox (TAX), No. 1129, Aug. 3, 2001.
U.S. Appl. No. 10/761,522, filed Jan. 21, 2004, Mandel et al.
U.S. Appl. No. 10/785,211, filed Feb. 24, 2004, Lofthus et al.
U.S. Appl. No. 10/881,619, filed Jun. 30, 2004, Bobrow.
U.S. Appl. No. 10/917,676, filed Aug. 13, 2004, Lofthus et al.
U.S. Appl. No. 10/917,768, filed Aug. 13, 2004, Lofthus et al.
U.S. Appl. No. 10/924,106, filed Aug. 23, 2004, Lofthus et al.
U.S. Appl. No. 10/924,113, filed Aug. 23, 2004, deJong et al.
U.S. Appl. No. 10/924,458, filed Aug. 23, 2004, Lofthus et al.
U.S. Appl. No. 10/924,459, filed Aug. 23, 2004, Mandel et al.
U.S. Appl. No. 10/933,556, filed Sep. 3, 2004, Spencer et al.
U.S. Appl. No. 10/953,953, filed Sep. 29, 2004, Radulski et al.
U.S. Appl. No. 10/999,326, filed Nov. 30, 2004, Grace et al.
U.S. Appl. No. 10/999,450, filed Nov. 30, 2004, Lofthus et al.
U.S. Appl. No. 11/000,158, filed Nov. 30, 2004, Roof.
U.S. Appl. No. 11/000,168, filed Nov. 30, 2004, Biegelsen et al.
U.S. Appl. No. 11/000,258, filed Nov. 30, 2004, Roof.
U.S. Appl. No. 11/051,817, filed Feb. 4, 2005, Moore et al.
U.S. Appl. No. 11/070,681, filed Mar. 2, 2005, Viturro et al.
U.S. Appl. No. 11/081,473, filed Mar. 16, 2005, Moore.
U.S. Appl. No. 11/069,020, filed Feb. 28, 2005, Lofthus et al.
U.S. Appl. No. 11/089,854, filed Mar. 25, 2005, Clark et al.
U.S. Appl. No. 11/090,498, filed Mar. 25, 2005, Clark.
U.S. Appl. No. 11/090,502, filed Mar. 25, 2005, Mongeon.
U.S. Appl. No. 11/095,378, filed Mar. 31, 2005, Moore et al.
U.S. Appl. No. 11/094,998, filed Mar. 31, 2005, Moore et al.
U.S. Appl. No. 11/094,864, filed Mar. 31, 2005, de Jong et al.
U.S. Appl. No. 11/095,872, filed Mar. 31, 2005, Julien et al.
U.S. Appl. No. 11/102,355, filed Apr. 8, 2005, Fromherz et al.
U.S. Appl. No. 11/084,280, filed Mar. 18, 2005, Mizes.
U.S. Appl. No. 11/109,566, filed Apr. 19, 2005, Mandel et al.
U.S. Appl. No. 11/109,558, filed Apr. 19, 2005, Furst et al.
U.S. Appl. No. 11/109,996, filed Apr. 20, 2005, Mongeon et al.
U.S. Appl. No. 11/093,229, filed Mar. 29, 2005, Julien.
U.S. Appl. No. 11/102,899, filed Apr. 8, 2005, Crawford et al.
U.S. Appl. No. 11/102,910, filed Apr. 8, 2005, Crawford et al.
U.S. Appl. No. 11/115,766, filed Apr. 27, 2005, Grace.
U.S. Appl. No. 11/102,332, filed Apr. 8, 2005, Hindi et al.
U.S. Appl. No. 11/136,959, filed May 25, 2005, German et al.
U.S. Appl. No. 11/122,420, filed May 5, 2005, Richards.
U.S. Appl. No. 11/137,634, filed May 25, 2005, Lofthus et al.
U.S. Appl. No. 11/137,251, filed May 25, 2005, Lofthus et al.
U.S. Appl. No. 11/137,273, filed May 25, 2005, Anderson et al.
U.S. Appl. No. 11/152,275, filed Jun. 14, 2005, Roof et al.
U.S. Appl. No. 11/156,778, filed Jun. 20, 2005, Swift.
U.S. Appl. No. 11/157,598, filed Jun. 21, 2005, Frankel.
U.S. Appl. No. 11/143,818, filed Jun. 2, 2005, Dalal et al.
U.S. Appl. No. 11/146,665, filed Jun. 7, 2005, Mongeon.
U.S. Appl. No. 11/166,299, filed Jun. 24, 2005, Moore.
U.S. Appl. No. 11/166,460, filed Jun. 24, 2005, Roof et al.
U.S. Appl. No. 11/166,581, filed Jun. 24, 2005, Lang et al.
U.S. Appl. No. 11/170,873, filed Jun. 30, 2005, Klassen.
U.S. Appl. No. 11/170,975, filed Jun. 30, 2005, Klassen.
U.S. Appl. No. 11/170,845, filed Jun. 30, 2005, Sampath et al.
U.S. Appl. No. 11/189,371, filed Jul. 26, 2005, Moore et al.
U.S. Appl. No. 11/212,367, filed Aug. 26, 2005, Anderson et al.
U.S. Appl. No. 11/208,871, filed Aug. 22, 2005, Dalal et al.
U.S. Appl. No. 11/215,791, filed Aug. 30, 2005, Hamby et al.
U.S. Appl. No. 11/234,468, filed Sep. 23, 2005, Hamby et al.
U.S. Appl. No. 11/234,553, filed Sep. 23, 2005, Mongeon.
U.S. Appl. No. 11/222,260, filed Sep. 8, 2005, Goodman et al.
U.S. Appl. No. 11/235,979, filed Sep. 27, 2005, Anderson et al.
U.S. Appl. No. 11/247,778, filed Oct. 11, 2005, Radulski et al.
U.S. Appl. No. 11/248,044, filed Oct. 12, 2005, Spencer et al.
U.S. Appl. No. 11/236,099, filed Sep. 27, 2005, Anderson et al.

* cited by examiner

MEDIA PATH DIAGNOSTICS WITH HYPER MODULE ELEMENTS

BACKGROUND

The present exemplary embodiments relate to systems wherein objects or media sheets are presented, delivered or produced by a plurality of sources and wherein one or more aspects of the presentation, delivery or production of the objects is diagnosed, measured, and/or controlled. Embodiments will be described in detail in regard to integrated document processing systems or rack mounted printing systems. However, embodiments in other object handling or producing systems are also contemplated.

Broadly, document processing systems can include feed devices, marking devices, transportation devices and output devices. For example, feed devices can include paper trays or drawers. Transportation systems can include conveying devices such as driven nips (spherical or cylindrical), conveyer belts, air jets or vacuums, transport paths, hyper modules, and other mechanisms. Finishing devices can include output trays, staplers, binders, shrink wrappers and bundlers. In the case of printers and copiers, marking devices can include document processors, print engines or integrated image marking engines (IMEs).

In copiers and printers, sheets or media, such as paper or velum are transported by an interposer, or an interposer system, from paper trays or drawers to a print engine or IME. The IME receives data directing the IME to place marks on the delivered sheet. The IME places the marks (e.g., text or an image) on the sheet and the interposer carries the sheet away for further processing or delivery. The interposer may include a reverser or inverter for flipping the sheet to present an opposite side for marking. Additionally, or alternatively the interposer may deliver the sheet to an output device, such as an output tray or a finisher.

There is a desire for systems and methods that can identify and associate defects or faults to a particular IME, pathway or transport, feeder, finisher, etc (hardware components). For integrated document processing systems, prints can be produced from multiple sources. Likewise, there can be multiple and redundant paths for transporting sheets through the system. Isolation of the source of a print defect or sheet damage fault is therefore more complex than for single engine systems. In one example of a problem, media sheets can be damaged in one component and move further through the system (i.e. downstream) before the failure, such as a paper jam, manifests itself. Isolation of the cause of a damaged media sheet delivered to the output has the potential to be very problematic and costly. In another example, if a spot defect is detected on some pages of a job, either visually or by a sensor, the operator or service representative must be able to isolate not only the type of subsystem creating the spot (such as a contaminated photo receptor), but must also determine which IME is involved. In the case of damaged sheets, the responsible paper path element or transport employed in producing the sheet or print needs to be isolated. Tools and methods for debugging a print system must therefore be available to associate a print defect, shortfall, fault, or variance with the IME that produced the print or the paper path element that caused the damage or fault.

The following applications, the disclosures of each being totally incorporated herein by reference are mentioned:

Application Ser. No. 11/212,367, filed Aug. 26, 2005, entitled "PRINTING SYSTEM," by David G. Anderson, et al., and claiming priority to U.S. Provisional Application Ser. No. 60/631,651, filed Nov. 30, 2004, entitled "TIGHTLY INTEGRATED PARALLEL PRINTING ARCHITECTURE MAKING USE OF COMBINED COLOR AND MONOCHROME ENGINES";

Application Ser. No. 11/235,979, filed Sep. 27, 2005, entitled "PRINTING SYSTEM," by David G. Anderson, et al., and claiming priority to U.S. Provisional Patent Application Ser. No. 60/631,918, filed Nov. 30, 2004, entitled "PRINTING SYSTEM WITH MULTIPLE OPERATIONS FOR FINAL APPEARANCE AND PERMANENCE", and U.S. Provisional Patent Application Ser. No. 60/631,921, filed Nov. 30, 2004, entitled "PRINTING SYSTEM WITH MULTIPLE OPERATIONS FOR FINAL APPEARANCE AND PERMANENCE";

Application Ser. No. 11/236,099, filed Sep. 27, 2005, entitled "PRINTING SYSTEM," by David G. Anderson, et al., and claiming priority to U.S. Provisional Patent Application Ser. No. 60/631,918, Filed Nov. 30, 2004, entitled "PRINTING SYSTEM WITH MULTIPLE OPERATIONS FOR FINAL APPEARANCE AND PERMANENCE", and U.S. Provisional Patent Application Ser. No. 60/631,921, filed Nov. 30, 2004, entitled "PRINTING SYSTEM WITH MULTIPLE OPERATIONS FOR FINAL APPEARANCE AND PERMANENCE";

U.S. application Ser. No. 10,761,522, filed Jan. 21, 2004, entitled "HIGH RATE PRINT MERGING AND FINISHING SYSTEM FOR PARALLEL PRINTING," by Barry P. Mandel, et al.;

U.S. application Ser. No. 10/785,211, filed Feb. 24, 2004, entitled "UNIVERSAL FLEXIBLE PLURAL PRINTER TO PLURAL FINISHER SHEET INTEGRATION SYSTEM," by Robert M. Lofthus, et al.;

U.S. application Ser. No. 10/881,619, filed Jun. 30, 2004, entitled "FLEXIBLE PAPER PATH USING MULTIDIRECTIONAL PATH MODULES," by Daniel G. Bobrow;

U.S. application Ser. No. 10/917,676, filed Aug. 13, 2004, entitled "MULTIPLE OBJECT SOURCES CONTROLLED AND/OR SELECTED BASED ON A COMMON SENSOR," by Robert M. Lofthus, et al.;

U.S. application Ser. No. 10/917,768, filed Aug. 13, 2004, entitled "PARALLEL PRINTING ARCHITECTURE CONSISTING OF CONTAINERIZED IMAGE MARKING ENGINES AND MEDIA FEEDER MODULES," by Robert M. Lofthus, et al.;

U.S. application Ser. No. 10/924,106, filed Aug. 23, 2004, entitled "PRINTING SYSTEM WITH HORIZONTAL HIGHWAY AND SINGLE PASS DUPLEX," by Robert M. Lofthus, et al.;

U.S. application Ser. No. 10/924,113, filed Aug. 23, 2004, entitled "PRINTING SYSTEM WITH INVERTER DISPOSED FOR MEDIA VELOCITY BUFFERING AND REGISTRATION," by Joannes N. M. deJong, et al.;

U.S. application Ser. No. 10/924,458, filed Aug. 23, 2004, entitled "PRINT SEQUENCE SCHEDULING FOR RELIABILITY," by Robert M. Lofthus, et al.;

U.S. application Ser. No. 10/924,459, filed Aug. 23, 2004, entitled "PARALLEL PRINTING ARCHITECTURE USING IMAGE MARKING ENGINE MODULES (as amended)," by Barry P. Mandel, et al.;

U.S. Pat. No. 6,959,165, issued Oct. 25, 2005, entitled "HIGH RATE PRINT MERGING AND FINISHING SYSTEM FOR PARALLEL PRINTING," by Barry P. Mandel, et al.;

U.S. application Ser. No. 10/933,556, filed Sep. 3, 2004, entitled "SUBSTRATE INVERTER SYSTEMS AND METHODS," by Stan A. Spencer, et al.;

U.S. application Ser. No. 10/953,953, filed Sep. 29, 2004, entitled "CUSTOMIZED SET POINT CONTROL FOR OUTPUT STABILITY IN A TIPP ARCHITECTURE," by Charles A. Radulski, et al.;

U.S. application Ser. No. 10/999,326, filed Nov. 30, 2004, entitled "SEMI-AUTOMATIC IMAGE QUALITY ADJUSTMENT FOR MULTIPLE MARKING ENGINE SYSTEMS," by Robert E. Grace, et al.;

U.S. application Ser. No. 10/999,450, filed Nov. 30, 2004, entitled "ADDRESSABLE FUSING FOR AN INTEGRATED PRINTING SYSTEM," by Robert M. Lofthus, et al.;

U.S. application Ser. No. 11/000,158, filed Nov. 30, 2004, entitled "GLOSSING SYSTEM FOR USE IN A TIPP ARCHITECTURE," by Bryan J. Roof;

U.S. application Ser. No. 11/000,168, filed Nov. 30, 2004, entitled "ADDRESSABLE FUSING AND HEATING METHODS AND APPARATUS," by David K. Biegelsen, et al.;

U.S. application Ser. No. 11/000,258, filed Nov. 30, 2004, entitled "GLOSSING SYSTEM FOR USE IN A TIPP ARCHITECTURE," by Bryan J. Roof;

U.S. Pat. No. 6,925,283, issued Aug. 2, 2005, entitled "HIGH PRINT RATE MERGING AND FINISHING SYSTEM FOR PARALLEL PRINTING," by Barry P. Mandel, et al.;

U.S. application Ser. No. 11/051,817, filed Feb. 4, 2005, entitled "PRINTING SYSTEMS," by Steven R. Moore, et al.;

U.S. application Ser. No. 11/069,020, filed Feb. 28, 2004, entitled "PRINTING SYSTEMS," by Robert M. Lofthus, et al.;

U.S. application Ser. No. 11/070,681, filed Mar. 2, 2005, entitled "GRAY BALANCE FOR A PRINTING SYSTEM OF MULTIPLE MARKING ENGINES," by R. Enrique Viturro, et al.;

U.S. application Ser. No. 11/081,473, filed Mar. 16, 2005, entitled "PRINTING SYSTEM," by Steven R. Moore;

U.S. application Ser. No. 11/084,280, filed Mar. 18, 2005, entitled "SYSTEMS AND METHODS FOR MEASURING UNIFORMITY IN IMAGES," by Howard Mizes;

U.S. application Ser. No. 11/089,854, filed Mar. 25, 2005, entitled "SHEET REGISTRATION WITHIN A MEDIA INVERTER," by Robert A. Clark, et al.;

U.S. application Ser. No. 11/090,498, filed Mar. 25, 2005, entitled "INVERTER WITH RETURN/BYPASS PAPER PATH," by Robert A. Clark;

U.S. application Ser. No. 11/090,502, filed Mar. 25, 2005, entitled IMAGE QUALITY CONTROL METHOD AND APPARATUS FOR MULTIPLE MARKING ENGINE SYSTEMS," by Michael C. Mongeon;

U.S. application Ser. No. 11/093,229, filed Mar. 29, 2005, entitled "PRINTING SYSTEM," by Paul C. Julien;

U.S. application Ser. No. 11/095,872, filed Mar. 31, 2005, entitled "PRINTING SYSTEM," by Paul C. Julien;

U.S. application Ser. No. 11/094,864, filed Mar. 31, 2005, entitled "PRINTING SYSTEM," by Jeremy C. deJong, et al.;

U.S. application Ser. No. 11/095,378, filed Mar. 31, 2005, entitled "IMAGE ON PAPER REGISTRATION ALIGNMENT," by Steven R. Moore, et al.;

U.S. application Ser. No. 11/094,998, filed Mar. 31, 2005, entitled "PARALLEL PRINTING ARCHITECTURE WITH PARALLEL HORIZONTAL PRINTING MODULES," by Steven R. Moore, et al.;

U.S. application Ser. No. 11/102,899, filed Apr. 8, 2005, entitled "SYNCHRONIZATION IN A DISTRIBUTED SYSTEM," by Lara S. Crawford, et al.;

U.S. application Ser. No. 11/102,910, filed Apr. 8, 2005, entitled "COORDINATION IN A DISTRIBUTED SYSTEM," by Lara S. Crawford, et al.;

U.S. application Ser. No. 11/102,355, filed Apr. 8, 2005, entitled "COMMUNICATION IN A DISTRIBUTED SYSTEM," by Markus P. J. Fromherz, et al.;

U.S. application Ser. No. 11/102,332, filed Apr. 8, 2005, entitled "ON-THE-FLY STATE SYNCHRONIZATION IN A DISTRIBUTED SYSTEM," by Haitham A. Hindi;

U.S. application Ser. No. 11/109,558, filed Apr. 19, 2005, entitled "SYSTEMS AND METHODS FOR REDUCING IMAGE REGISTRATION ERRORS," by Michael R. Furst, et al.;

U.S. application Ser. No. 11/109,566, filed Apr. 19, 2005, entitled "MEDIA TRANSPORT SYSTEM," by Barry P. Mandel, et al.;

U.S. application Ser. No. 11/109,996, filed Apr. 20, 2005, entitled "PRINTING SYSTEMS," by Michael C. Mongeon, et al.;

U.S. application Ser. No. 11/115,766, Filed Apr. 27, 2005, entitled "IMAGE QUALITY ADJUSTMENT METHOD AND SYSTEM," by Robert E. Grace;

U.S. application Ser. No. 11/122,420, filed May 5, 2005, entitled "PRINTING SYSTEM AND SCHEDULING METHOD," by Austin L. Richards;

U.S. application Ser. No. 11/136,959, filed May 25, 2005, entitled "PRINTING SYSTEMS," by Kristine A. German, et al.;

U.S. application Ser. No. 11/137,634, filed May 25, 2005, entitled "PRINTING SYSTEM," by Robert M. Lofthus, et al.;

U.S. application Ser. No. 11/137,251, filed May 25, 2005, entitled "SCHEDULING SYSTEM," by Robert M. Lofthus, et al.;

U.S. C-I-P application Ser. No. 11/137,273, filed May 25, 2005, entitled "PRINTING SYSTEM," by David G. Anderson, et al.;

U.S. application Ser. No. 11/143,818, filed Jun. 2, 2005, entitled "INTER-SEPARATION DECORRELATOR," by Edul N. Dalal, et al.;

U.S. application Ser. No. 11/146,665, filed Jun. 7, 2005, entitled "LOW COST ADJUSTMENT METHOD FOR PRINTING SYSTEMS," by Michael C. Mongeon;

U.S. application Ser. No. 11/152,275, filed Jun. 14, 2005, entitled "WARM-UP OF MULTIPLE INTEGRATED MARKING ENGINES," by Bryan J. Roof, et al.;

U.S. application Ser. No. 11/156,778, filed Jun. 20, 2005, entitled "PRINTING PLATFORM," by Joseph A. Swift;

U.S. application Ser. No. 11/157,598, filed Jun. 21, 2005, entitled "METHOD OF ORDERING JOB QUEUE OF MARKING SYSTEMS," by Neil A. Frankel;

U.S. application Ser. No. 11/166,460, filed Jun. 24, 2005, entitled "GLOSSING SUBSYSTEM FOR A PRINTING DEVICE," by Bryan J. Roof, et al.;

U.S. application Ser. No. 11/166,581, filed Jun. 24, 2005, entitled "MIXED OUTPUT PRINT CONTROL METHOD AND SYSTEM," by Joseph H. Lang, et al.;

U.S. application Ser. No. 11/166,299, filed Jun. 24, 2005, entitled "PRINTING SYSTEM," by Steven R. Moore;

U.S. application Ser. No. 11/170,975, filed Jun. 30, 2005, entitled "METHOD AND SYSTEM FOR PROCESSING SCANNED PATCHES FOR USE IN IMAGING DEVICE CALIBRATION," by R. Victor Klassen;

U.S. application Ser. No. 11/170,873, filed Jun. 30, 2005, entitled "COLOR CHARACTERIZATION OR CALIBRATION TARGETS WITH NOISE-DEPENDENT PATCH SIZE OR NUMBER," by R. Victor Klassen;

U.S. application Ser. No. 11/170,845, filed Jun. 30, 2005, entitled "HIGH AVAILABILITY PRINTING SYSTEMS," by Meera Sampath, et al.;

U.S. application Ser. No. 11/189,371, filed Jul. 26, 2005, entitled "PRINTING SYSTEM," by Steven R. Moore, et al.;

U.S. application Ser. No. 11/208,871, filed Aug. 22, 2005, entitled "MODULAR MARKING ARCHITECTURE FOR WIDE MEDIA PRINTING PLATFORM," by Edul N. Dalal, et al.;

U.S. application Ser. No. 11/215,791, filed Aug. 30, 2005, entitled "CONSUMABLE SELECTION IN A PRINTING SYSTEM", by Eric Hamby, et al.;

U.S. application Ser. No. 11/222,260, filed Sep. 8, 2005, entitled "METHOD AND SYSTEMS FOR DETERMINING BANDING COMPENSATION PARAMETERS IN PRINTING SYSTEMS", by Goodman, et al.;

U.S. application Ser. No. 11/234,553, filed Sep. 23, 2005, entitled "MAXIMUM GAMUT STRATEGY FOR THE PRINTING SYSTEMS", by Michael C. Mongeon;

U.S. application Ser. No. 11/234,468, filed Sep. 23, 2005, entitled "PRINTING SYSTEM", by Eric Hamby, et al.;

U.S. application Ser. No. 11/247,778, filed Oct. 11, 2005, entitled "PRINTING SYSTEM WITH BALANCED CONSUMABLE USAGE", by Charles Radulski, et al.;

U.S. application Ser. No. 11/248,044, filed Oct. 12, 2005, entitled "MEDIA PATH CROSSOVER FOR PRINTING SYSTEM", by Stan A. Spencer, et al.; and U.S. application Ser. No. 11/274,638, filed Nov. 15, 2005, entitled "GAMUT SELECTION IN MULTI-ENGINE SYSTEMS", by Wencheng Wu, et al.;

U.S. application Ser. No. 11/287,177, filed Nov. 23, 2005, entitled "MEDIA PASS THROUGH MODE FOR MULTI-ENGINE SYSTEM", by Barry P. Mandel, et al.;

U.S. application Ser. No. 11/287,685, filed Nov. 28, 2005, entitled "MULTIPLE IOT PHOTORECEPTOR BELT SEAM SYNCHRONIZATION, by Kevin M. Carolan;

U.S. application Ser. No. 11/291,860, filed Nov. 30, 2005, entitled "MEDIA PATH CROSSOVER CLEARANCE FOR PRINTING SYSTEM", by Keith L. Willis;

U.S. application Ser. No. 11/292,388, filed Nov. 30, 2005, entitled "PRINTING SYSTEM", by David A. Mueller;

U.S. application Ser. No. 11/292,163, filed Nov. 30, 2005, entitled "RADIAL MERGE MODULE FOR PRINTING SYSTEM", by Barry P. Mandel, et al.;

U.S. application Ser. No. 11/291,583, filed Nov. 30, 2005, entitled "MIXED OUTPUT PRINTING SYSTEM", by Joseph H. Lang;

BRIEF DESCRIPTION

A system for handling media sheets is provided which comprises a plurality of hardware components including a first image marking engine operative to mark media sheets, and a second image marking engine operative to mark media sheets. In addition, the plurality of hardware components can include a first object delivery path operative to transport media sheets presented by the first image marking engine to a first destination, and a second object delivery path operative to transport media sheets presented by the second image marking engine to a second destination. The first and second destinations may be a single destination, separate destinations, or interchangeable destinations. One of the first and second delivery paths can be redundant. At least one of the first and second delivery paths includes a hyper module for transporting a series of diagnostic media sheets in both forward and reverse directions through a first recursive loop through the plurality of hardware components within the system during a diagnostic sequence whereby a fault is detected.

A method for diagnosing faults in a xerographic system is provided which includes transporting a series of diagnostic media sheets in forward and reverse directions through the system having a hyper module and a plurality of hardware components wherein the hardware components can be selected from the group consisting of a distributor, a collector, an output interface module, an integrated marking engines (IME), an inverter, and a transport path. The method further includes recursively feeding the series of media sheets through successive loops within the system whereby the diagnostic media sheets pass through a first recursive loop during a diagnostic sequence whereby a fault is detected.

A method is provided for fault isolation in a multiple marking engine system, the method comprises circulating a diagnostic sheet through a first recursive loop, at least one hyper module, and a plurality of hardware components wherein the hardware components can be selected from the group consisting of a distributor, a collector, an output interface module, an integrated marking engines (IME), an inverter, and a transport path. The method further provides for identifying a fault with at least one of the hardware components and isolating a source of the fault to exclude at least a portion of one of the hardware components downstream from the fault.

DETAILED DESCRIPTION

Figure 1:
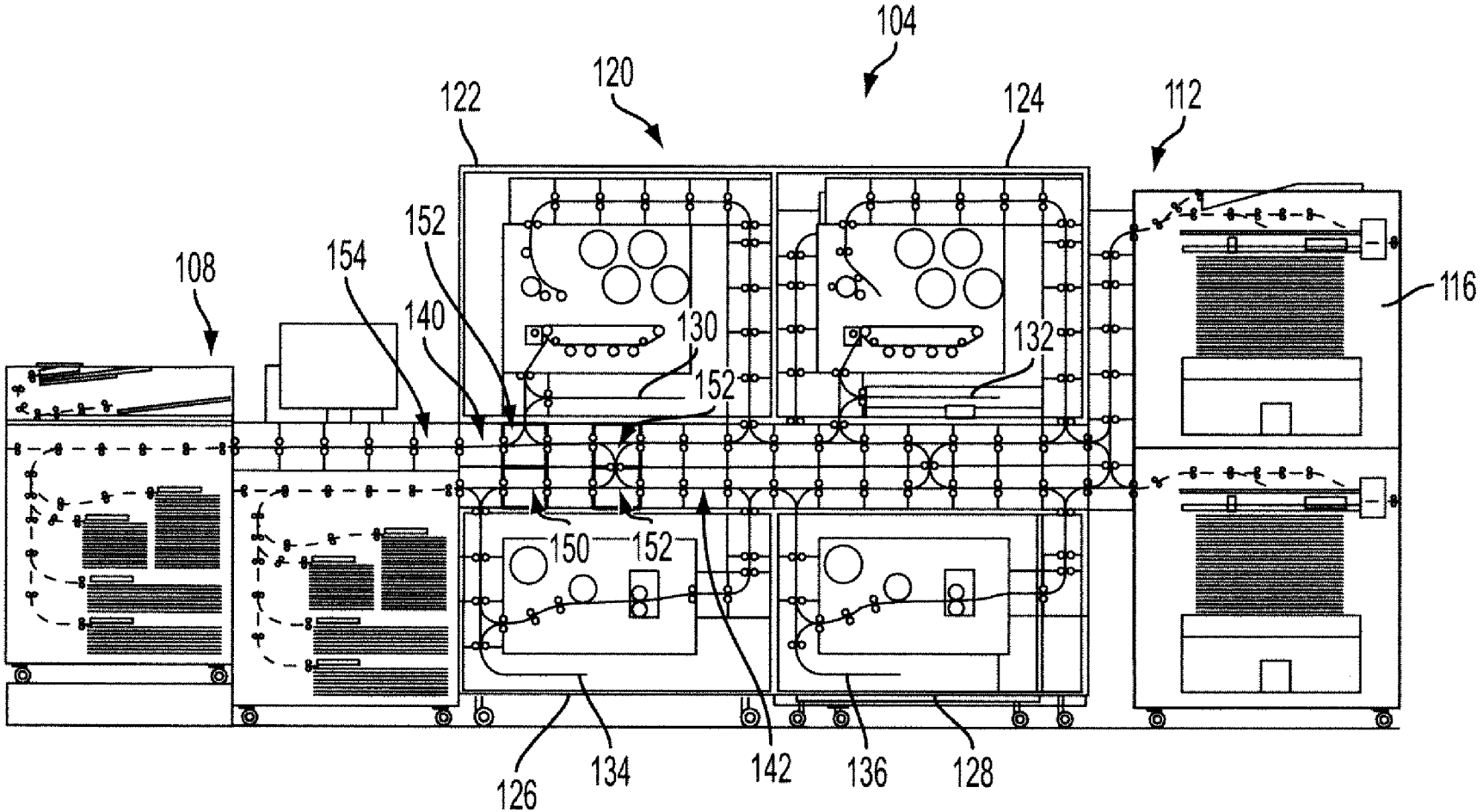
FIG. 1 is a diagram of a document processing system including multiple redundant transport paths and an array of hyper modules.

A set of tests procedures and supporting devices is described hereinafter to aid in the identification and/or isolation of print defects and print quality shortfalls in integrated document processing systems. These can include a viewable log of integrated test print analysis results, a hard copy annotation of test print results on an associated test print sheet or diagnostic sheet. The set of test procedures further isolates a print defect, shortfall, fault, or variance to one or more components through automated or selected systematic routing of diagnostic media sheets. Alerts can also be issued to the operator when an automated procedure isolates a potential problem.

The method, to be described in more detail hereinafter, includes utilizing redundant media paths and hyper modules capable of moving sheets in both forward and reverse directions. The system can recognize all possible media paths through a plurality of hardware components and sequentially feed the diagnostic sheets through each path and through a failure point, for example a physical jam location, and in this manner isolate the path or loop causing the fault or problem. A series of diagnostic prints can be routed initially through all possible media paths, whereby each successive path or loop thereafter 'narrows', i.e. excludes one or more components, from the previous path. By narrowing the path or loop, moving from the problem detection area back through the system towards the feeding system, a downstream problem can be isolated to upstream hardware.

Some printing systems may exhibit intermittent faults. If the fault is intermittent, recursively feeding a series of media sheets repeatedly through a selected media path, making use of the return highways, can aid in the identification of the problem area. Recirculating media sheets repeatedly through the selected path will not only provide multiple opportunities for manifestation of an intermittent problem, but can also tend to amplify the magnitude of a document defect by repeatedly subjecting the sheet to the offending hardware.

To be described in more detail hereinafter is one or more ways to inform the operator of the test results associated with each IME, i.e. performance monitoring. At the incidence of a shutdown, the system can record the shutdown location and the media path in use at the time the shutdown occurred. This data will not only be of great assistance to the service engineer in identifying failed media path components, but also has the potential to provide design performance data back to the product engineering community.

Automation of the aforementioned diagnostics and incorporation of knowledge of historical failure mode frequency in the related algorithms has the potential to reduce mean service hours (MSH) and the related field service costs. The reduction in total run cost will make the system more competitive in the market place.

Diagnostic prints or media sheets and test results can be aggregated on a single page by exploiting the sheet recirculation and overprinting capabilities of integrated image marking engines. In addition, redundant transport paths and hyper modules can be incorporated to recursively feed diagnostic media sheets forward and backwards through the system in defined loops. A loop can represent a path through the system in which a series of diagnostic sheets travel.

Referring to FIG. 1, wherein the method for isolating a fault is therein illustrated and described hereinafter with reference to one exemplary system. As shown in FIG. 1, a system or processor 104 is illustrated which can include a distributor 108, a collector 112, an output interface module 116 and a plurality 120 of integrated marking engines (IMEs) including a first 122, second 124, third 126 and fourth 128 integrated marking engines. It is to be appreciated that the aforementioned components, are by way example only, selected from the group of hardware components including feed devices, marking devices, transporting devices, and output devices. For instance, the first and second 122, 124 IMEs are color integrated marking engines and the third and fourth 126, 128 render images using only a single colorant (e.g., black). Each of the first, second, third and fourth IMEs 122, 124, 126, 128 can include input inverters 130, 132, 134, 136. A series of object delivery hyper modules 154 provide delivery paths for transporting objects (e.g., media sheets or pages) from the distributor 108 to the IMEs 122, 124, 126, 128, the collector 112 and/or to the output interface module 116.

The exemplary system 104 includes two horizontal transport highways 140, 142 between the color marking engines 122, 124 and black marking engines 126, 128. The transport highways 140, 142 can transport media sheets in both forward and reverse directions. The highways include an array or series of hyper modules which are capable of moving media in at least two directions. Some of the hyper modules 150 move media forwards and backwards along the transport paths. Other hyper modules 152 move media from one transport path to another transport path or from one transport path to a marking engine. The movement of media through hyper modules 150, 152, i.e. their source and destination, are dependent upon location of the hyper modules in the system 104. It is to be appreciated that the combination of hyper modules 150, 152 and transport paths 140, 142 enables media to move to and from any hardware component in the system 104. Media can selectively and sequentially move in opposing directions along the different pathways through each hyper module.

Figure 2:
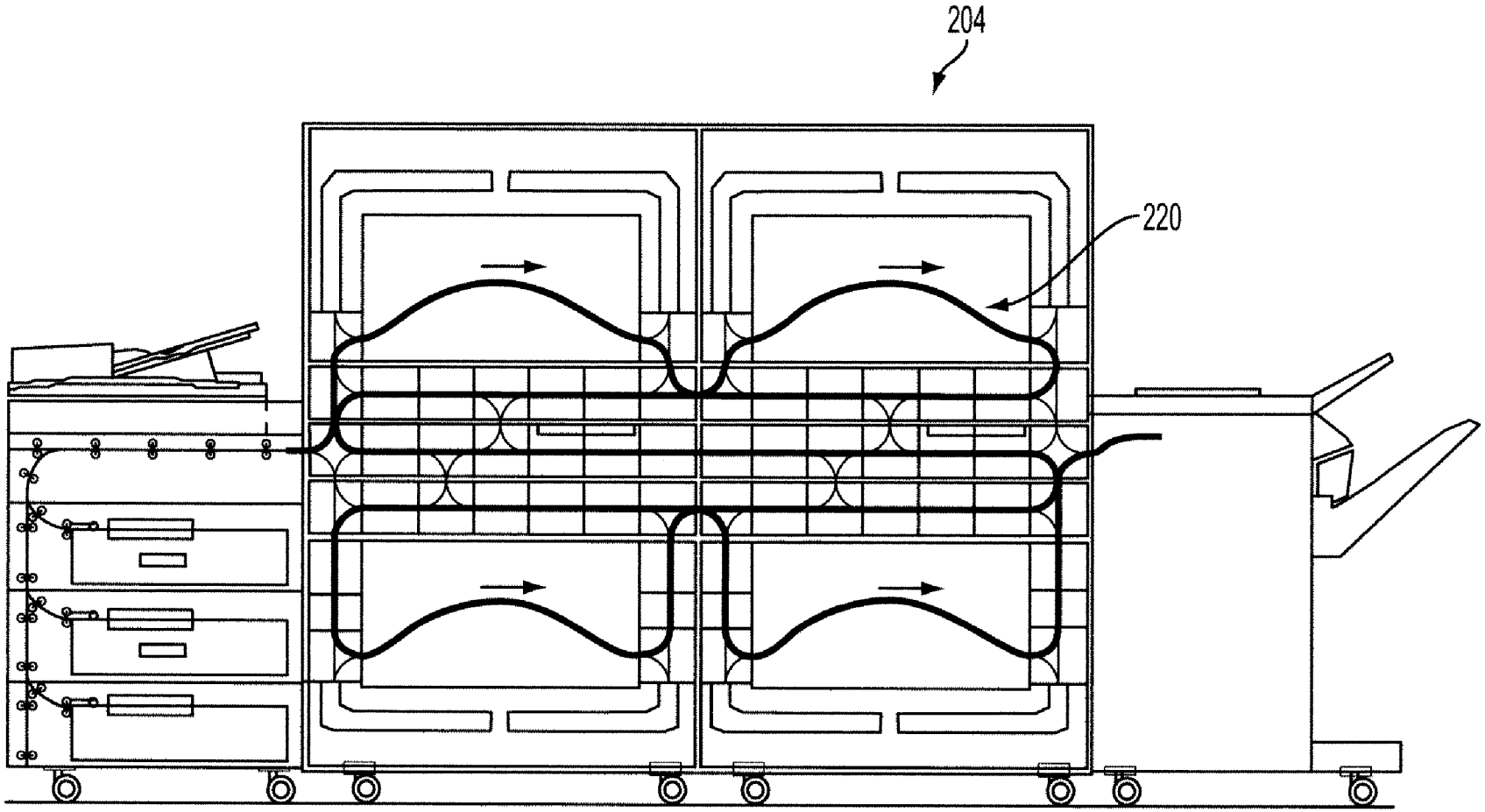
FIG. 2 is a diagram of a document processing system illustrating an exemplary first diagnostic loop.
Figure 3:
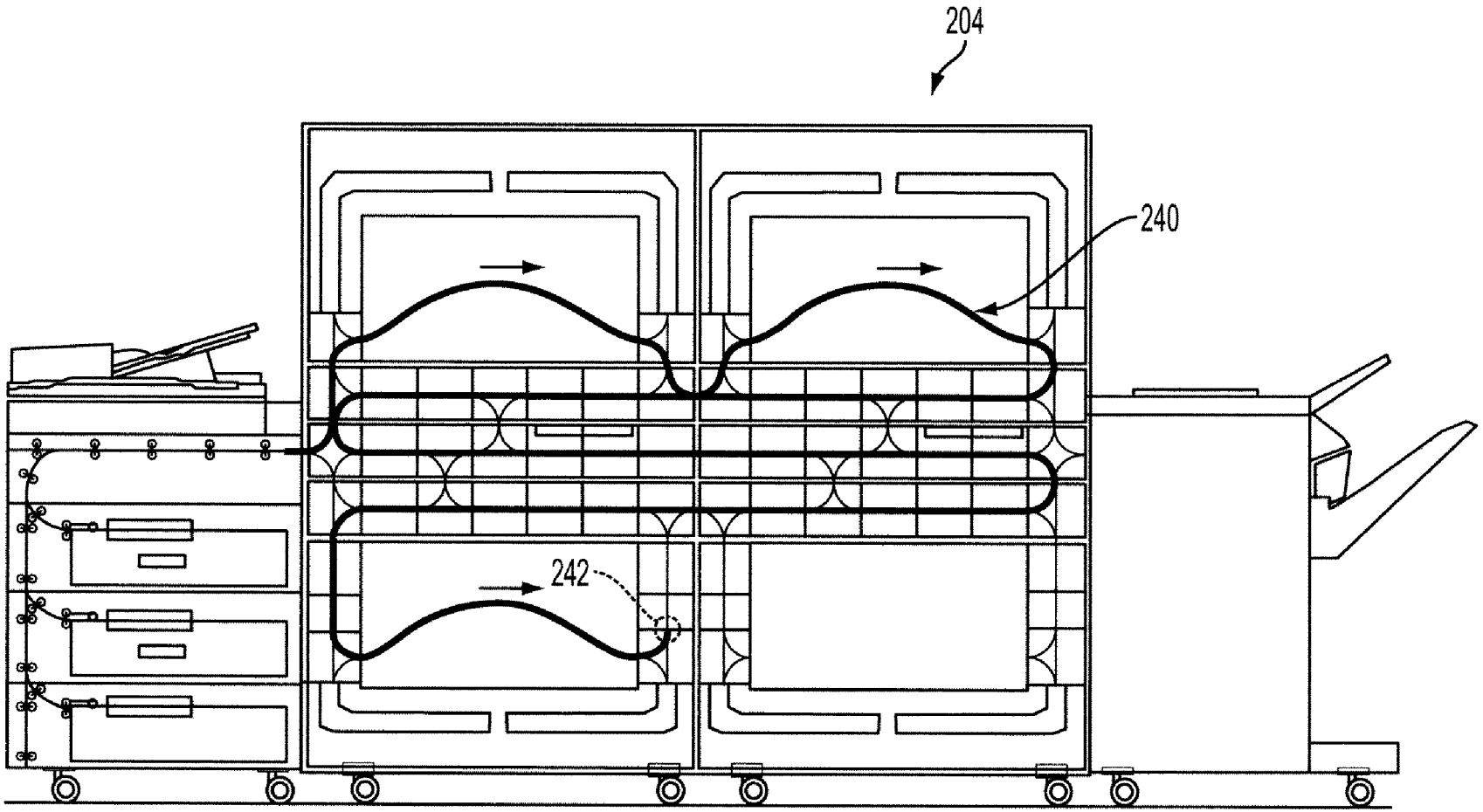
FIG. 3 is a diagram of a document processing system illustrating an exemplary second diagnostic loop; and, FIG. 4 is a diagram of a document processing system illustrating an exemplary third diagnostic loop.
Figure 4:
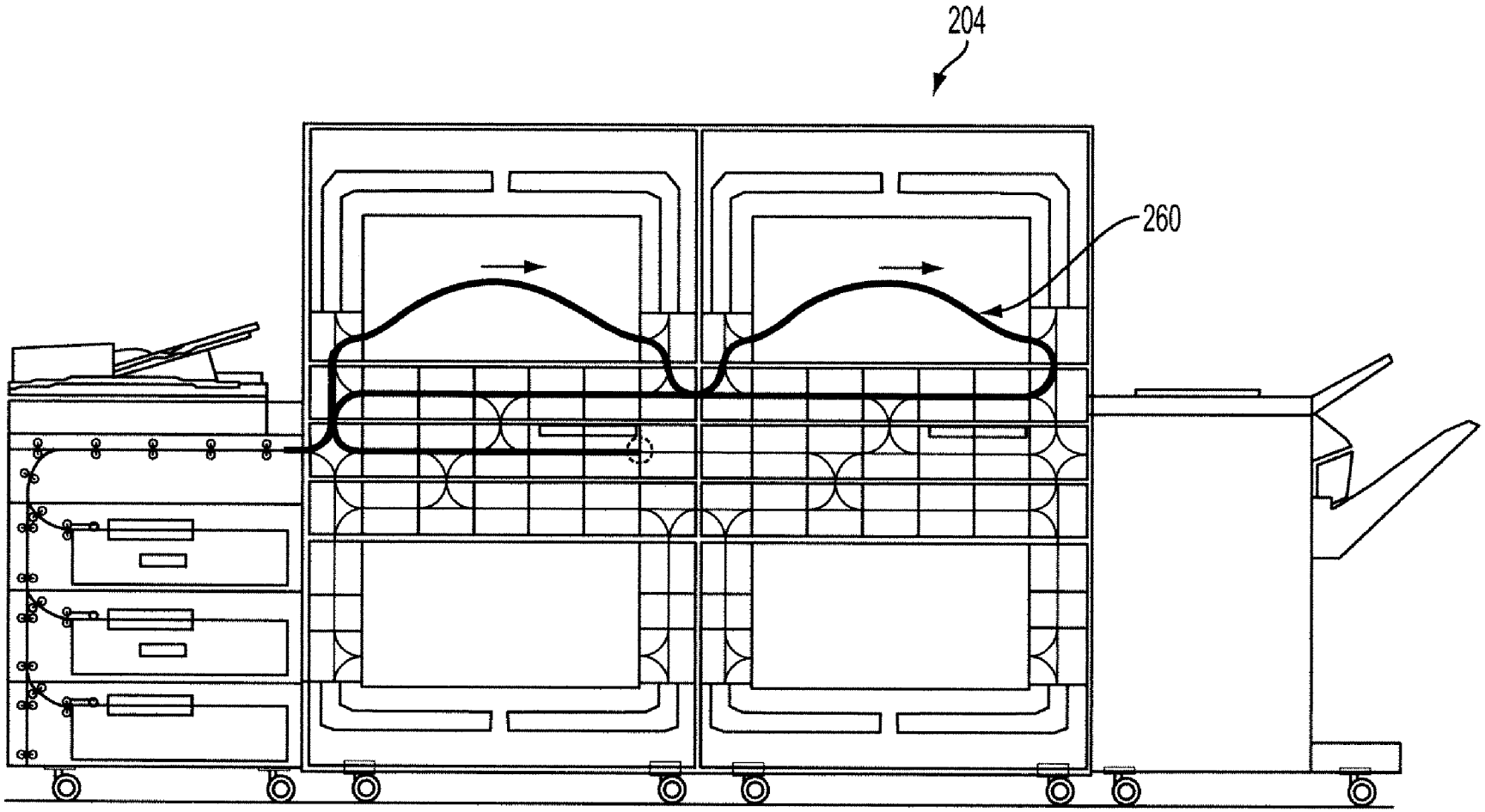

Referring now to FIG. 2-4, wherein exemplary recursive loops are employed and illustrated in a method for diagnosing faults in a xerographic system. A series of diagnostic media sheets can be routed through a system 204 in a first routing path 220 including all of the image marking engines and the transport paths (FIG. 2). The first routing path 220 of the diagnostic media sheets can include all the hardware in a first recursive or diagnostic loop. After the diagnostic sheets have been sequentially fed through each path and through the failure point (i.e. physical jam location), the source of the fault can be identified or the possible sources of the fault can be narrowed. Narrowing the source of the fault logically can include eliminating all downstream hardware components from the fault detection location.

A second set of diagnostic media sheets can be fed through a second loop 240, refer to FIG. 3, moving from the problem detection area or location 242 back through the system towards the feeding system. This narrowing or shortening of the loop enables a downstream problem to be isolated to upstream hardware. Again, once certain hardware (i.e. downstream hardware) is eliminated from the possible sources of the fault, a third narrower diagnostic loop 260, refer to FIG. 4, can be used to route a third diagnostic run of media sheets. These steps, and successively narrower diagnostic loops, can be repeated until the fault is isolated and identified in the system. After the initial diagnostic sequence and routing loop 220, it is to be appreciated that each successive diagnostic loop (i.e. 240, 260) can exclude one or more of the hardware components as a source of the fault. The excluding of hardware components can involve one or more IME and one or more hyper module, or an entire array of hyper modules along a transport path, for example. Additionally, excluding of hardware components can involve a portion of one or more components.

If the problem is intermittent, recursively feeding a series of sheets repeatedly through, for example, the third diagnostic loop 240, will aid in the identification of the problem area. Recirculating media sheets through the same designated path repeatedly will not only provide multiple opportunities for manifestation of an intermittent problem, but will also tend to 'amplify' the magnitude of a document defect by repeatedly subjecting the media sheets to the offending hardware.

As discussed above, the method for isolating a fault can include circulating recursively one or more diagnostic sheets through at least one hyper module and a first recursive loop including at least one hardware component. The hardware components can be selected from, for example, a distributor, a collector, an output interface module, an integrated marking engines (IME), an inverter, and a transport path.

A first series of diagnostic sheets can be fed through the system in a first loop diagnostic or test print. The first loop, for example, can incorporate all the system hardware. After the diagnostic media sheets have traveled through the first loop, the operator can review the output to determine the type of fault. If the fault is a 'marking' fault, then a second series of diagnostic prints can be fed through the system in a second loop incorporating the marking engines and only the necessary hardware components to transport the series of diagnostic prints to the marking engines.

The troubleshooting method can use automated strategies such as interval splitting to isolate a malfunctioning component. A very simple example is for the operator to call up a troubleshooting application and indicate the intermittent presence of an image defect. The machine then prints one or more test sheets from each IME with the IME identified on each sheet. The operator is then prompted to indicate on which sheet (if any) the defect is visible. If an IME is indicated, the operator is provided the information necessary to decide on a next course of action, for example, a successive loop for further diagnostics. The operator may be prompted for additional information to better match the isolation strategy to the type of fault.

The exemplary system 104 can include one or more main outputs (not illustrated). The main outputs may provide additional processing or may simply be output collecting bins or trays. For instance, where the exemplary system 104 is a document processor the output devices may provide finishing services, printing services, or output collection services. For example, the first output may be a stapler, binder or shrink wrapping device. The second output might be a simple document or sheet collection tray or collator.

In embodiments where sensed objects are special or diagnostic in nature, it may be inappropriate to direct sensed objects to output devices intended for normal or main production items. In such embodiments, after the diagnostic sequence is completed, the diagnostic media sheets may be directed along a discard path (not illustrated) to the discard bin. For example, in a document processor, the discard bin might be a purge tray to which sample jobs, diagnostic sheets and other non-main job items may be directed.

Diagnostic events may be triggered on the basis of any aspect of production appropriate to controlling or compensating for a desired aspect of image quality. However, it is anticipated that many of the aspects of image quality for which embodiments will be implemented to compensate or correct for will be static or semi-static in nature. That is, many of the aspects of image quality correlated by embodiments of the methods and systems, described above, will change only slowly, with changes being detectable only over periods of many minutes, hours, days or months. Some aspects will change due to marking engine wear. Some aspects will vary based on ambient or machine temperature and/or humidity. Thermal expansion and contraction, charge retention, toner age and ability to de-agglomerate, ink viscosity, developer and nip wear and laser or light source efficiency are just a few aspects of document processing systems that affect image quality and which change slowly over time or with the number of images printed or rendered.

Default triggering events may be selected or configured by system designers. Additionally, or alternatively, embodiments may provide for document processing system operators to configure appropriate diagnostic event triggering events. For instance, a first kind of diagnostic event may be triggered whenever a document processor is powered up or started. Additionally, or alternatively, a diagnostic event may be triggered on a regular basis, such as, every 20 minutes or whenever some predetermined number of sheets or images are printed or rendered. Still other diagnostic events may be triggered on the basis of temperature or humidity changes. Additional iterations may be triggered as required or as a matter of course. Of course, diagnostic events and sequences for same may be triggered at the request or direction of a system operator.

The exemplary embodiment has been described with reference to the preferred embodiments. Obviously, modifications and alterations will occur to others upon reading and understanding the preceding detailed description. It is intended that the exemplary embodiment be construed as including all such modifications and alterations insofar as they come within the scope of the appended claims or the equivalents thereof.

The invention claimed is:

1. A method for handling media sheets, the method comprising:

providing a plurality of hardware components including:

a first image marking engine operative to mark media sheets;

a second image marking engine operative to mark media sheets;

a first media sheet delivery path allowing for the transportation of said media sheets marked by the first image marking engine to a first destination;

a second media sheet delivery path allowing for the transportation of said media sheets marked by the second image marking engine to a second destination, wherein the first and second destinations may be a single destination or separate destinations;

using at least one of said first and second delivery paths including a hyper module for selectively transporting a series of diagnostic media sheets in both forward and reverse directions through a first recursive loop in said forward direction through the plurality of hardware components, wherein said hyper module selectively transports said series of diagnostic media sheets from said first image marking engine to said second image marking engine and from said second image marking engine to said first image marking engine, within a system during a diagnostic sequence whereby a fault is detected; and, transporting said series of diagnostic media sheets through a second recursive loop, wherein said second recursive loop is a subset of said first recursive loop excluding at least one hardware component of the plurality of hardware components from said first recursive loop to determine if said fault is isolated to said excluded at least one hardware component; and, selectively continuing to exclude at least another hardware component from the plurality of hardware components with at least another subsequent recursive loop until said fault is isolated, wherein said at least another subsequent recursive loop is a subset of each previous recursive loop.

2. The method of claim 1, wherein the hyper module is operative to receive the series of media sheets from the first media sheet delivery path and the second media sheet delivery path.

3. The method of claim 2, wherein the diagnostic sequence includes transporting the series of diagnostic media sheets in both forward and reverse directions through said second recursive loop within the system thereby enabling isolation of a fault source to be narrowed.

4. A method for handling media sheets, the method comprising:

transporting a series of diagnostic media sheets in forward and reverse directions through a system having a hyper module and a plurality of hardware components wherein the plurality of hardware components are selected from the group consisting of a distributor, a collector, an output interface module, a first image marking engine operative to mark media sheets, a second image marking engine operative to mark media sheets, an inverter, and a transport path;

recursively feeding the series of diagnostic media sheets through successive loops within the system whereby the diagnostic media sheets pass though one recursive loop during a diagnostic sequence whereby a fault is detected;

feeding the series of diagnostic media sheets through another recursive loop excluding at least one hardware component of the plurality of hardware components downstream from the fault detection wherein said another recursive loop is a subset of said one recursive loop to determine if said fault is isolated to said excluded at least one hardware component; and, selectively continuing to exclude at least another hardware component from the plurality of hardware components with at least another subsequent recursive loop until said fault is isolated, wherein said at least another subsequent recursive loop is a subset of each previous recursive loop.

5. A method for handling media sheets in a multiple marking engine xerographic system, the method comprising:

circulating a diagnostic sheet through a first recursive loop including at least one hyper module and a plurality of hardware components wherein the plurality of hardware components are selected from the group consisting of a distributor, a collector, an output interface module, a first integrated image marking engine, a second integrated image marking engine, an inverter, and a transport path;

identifying a fault with at least one hardware component of the plurality of hardware components;

isolating a source of the fault by excluding at least a portion of one of the hardware components downstream from the fault;

wherein isolating the source of the fault comprises circulating the diagnostic sheet through a second recursive loop to exclude at least a portion of another of the hardware components to determine if said fault is isolated to said excluded hardware components;

wherein the second recursive loop is a subset of the first recursive loop; and, selectively continuing to exclude at least another hardware component from the plurality of hardware components with at least another subsequent recursive loop until said fault is isolated, wherein said at least another subsequent recursive loop is a subset of each previous recursive loop.

6. The method of claim 5, wherein isolating the source of the fault further comprises:

recirculating the diagnostic sheet repeatedly through the second recursive loop.

* * * * *